US005242718A

United States Patent [19]

Gillette et al.

[11] Patent Number: 5,242,718

[45] Date of Patent: * Sep. 7, 1993

[54] COATING APPARATUS AND METHOD WITH FLUIDIZED BED FEED EFFECT

[75] Inventors: Donald J. Gillette, Guilford; Bedrich Hajek, Clinton both of Conn.

[73] Assignee: Electrostatic Technology, Inc., Branford, Conn.

[ * ] Notice: The portion of the term of this patent subsequent to Aug. 20, 2008 has been disclaimed.

[21] Appl. No.: 747,388

[22] Filed: Aug. 20, 1991

Related U.S. Application Data

[63] Continuation-in-part of Ser. No. 476,356, Feb. 7, 1990, Pat. No. 4,989,352, which is a continuation-in-part of Ser. No. 366,871, Jun. 15, 1987, Pat. No. 4,950,497.

[51] Int. Cl.[5] ..... B05D 1/04

[52] U.S. Cl. ..... 427/459; 118/309; 118/312; 118/622; 118/630; 118/DIG. 5; 427/182; 427/185; 427/476

[58] Field of Search ..... 427/28, 182, 185, 459, 427/476; 118/309, 312, 622, 629, 630, DIG. 5

[56] References Cited

U.S. PATENT DOCUMENTS

| | | | |
|---|---|---|---|
| 3,004,861 | 10/1961 | Davis | 117/18 |
| 3,248,253 | 4/1966 | Barford et al. | 117/17 |
| 3,537,426 | 11/1970 | Spiller et al. | 118/629 |
| 3,560,239 | 2/1971 | Facer et al. | 117/17 |
| 3,799,112 | 3/1974 | Huteaux | 118/629 |
| 3,828,729 | 8/1974 | Goodridge | 118/634 |
| 3,914,461 | 10/1975 | Goodridge | 427/33 |
| 3,916,826 | 11/1975 | Knudsen | 118/629 |
| 3,937,179 | 2/1976 | Goodridge | 118/301 |
| 4,011,832 | 3/1977 | Westervelt et al. | 118/301 |
| 4,030,446 | 6/1977 | Karr | 118/654 |
| 4,053,661 | 10/1977 | Goodridge | 427/185 |
| 4,073,265 | 2/1978 | Walling et al. | 118/634 |
| 4,101,687 | 7/1978 | Knudsen | 427/25 |
| 4,123,175 | 10/1978 | Carlson et al. | 366/151 |

FOREIGN PATENT DOCUMENTS 925021 5/1963 United Kingdom .

*Primary Examiner*—Bernard Pianalto
*Attorney, Agent, or Firm*—Ira S. Dorman

[57] ABSTRACT

An apparatus and method for coating surfaces of workpieces employs an electrostatic fluidized bed unit for producing a cloud of charged particles, for deposition upon the workpiece, and a second fluidized bed for agitating the particulate material and for facilitating feeding thereof to the electrostatic coating bed, the second bed being disposed beneath the first bed, and being in powder flow communication with it.

6 Claims, 3 Drawing Sheets

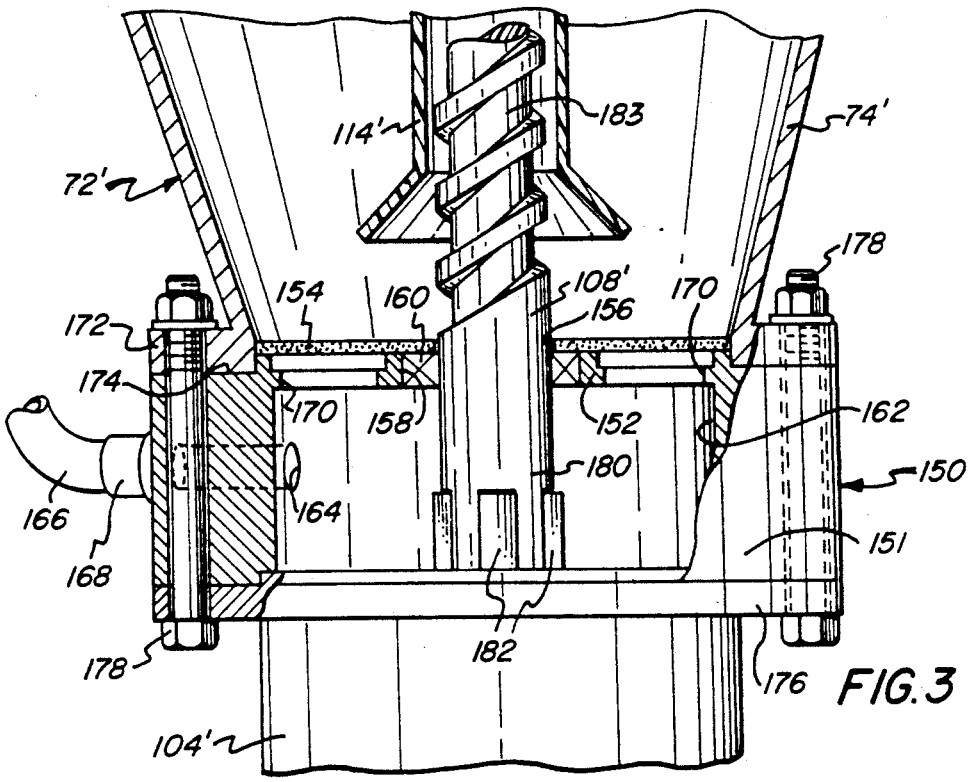
FIG. 3
FIG. 4
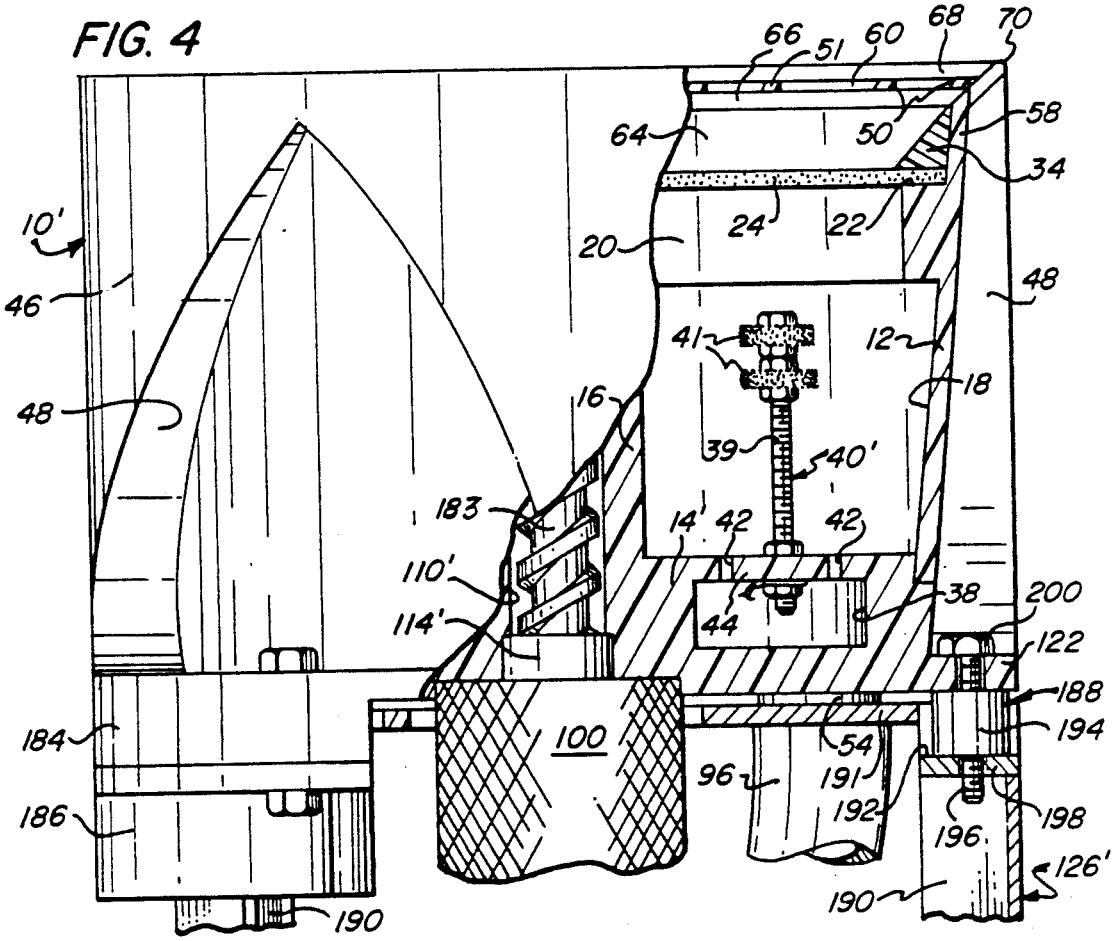

COATING APPARATUS AND METHOD WITH FLUIDIZED BED FEED EFFECT

CROSS REFERENCE TO RELATED APPLICATION

This application is a continuation-in-part of copending application for U.S. Ser. No. 07/476,356, filed Feb. 7, 1990, now issued as U.S. Pat. No. 4,989,352; which in turn is a continuation-in-part of application for Ser. No. 07/366,871, filed Jun. 15, 1987 and now issued as U.S. Pat. No. 4,950,497.

BACKGROUND OF THE INVENTION

Electrostatic fluidized bed coating is now a conventional and widely-used technique for depositing particulate materials upon a great diversity of workpieces. Methods and apparatus for electrostatic coating are well known in the art, as broadly exemplified by Knudsen U.S. Pat. Nos. 3,916,826 and 4,101,687, issued respectively on Nov. 4, 1975 and Jul. 18, 1978, and Karr U.S. Pat. No. 4,030,446, issued Jun. 21, 1977. The prior art also discloses techniques by which coatings of electrostatically charged particles can be developed progressively upon workpiece surfaces during movement thereof relative to a fluidized bed, as in Goodridge U.S. Pat. Nos. 3,828,729 and 3,914,461, issued respectively Aug. 13, 1974 and Oct. 21, 1975, and Westervelt et al U.S. Pat. No. 4,011,832, issued Mar. 15, 1977; non-electrostatic techniques, carried out similarly, are described in Goodridge U.S. Pat. Nos. 3,937,179 and 4,053,661, issued respectively on Feb. 10, 1976 and Oct. 11, 1977.

Efforts have been made in the past to utilize fluidized bed techniques, of both electrostatic and nonelectrostatic character, for developing powder coatings upon the inside surfaces of objects. Patents disclosing such concepts include Davis U.S. Pat. No. 3,004,861, issued Oct. 17, 1961, Barford et al U.S. Pat. No. 3,248,253, issued Apr. 26, 1966 (see FIG. 10), and Major et al United Kingdom Specification No. 925,021, published May 1, 1963. The Davis patent, in FIG. 2, shows apparatus for coating the inner surface of a tubular conduit utilizing a cup-like container, and container having a vertical wall that terminates in an outwardly flared lip and that closely approaches the surface to be coated. Powdered coating material is fluidized upon a porous plate disposed deeply within the container, and additional material may be supplied through a funnel member that is connected to a tube, which may extend either downwardly into the container or upwardly through the bottom thereof. In applying the coating material the container and conduit are moved relative to one another, and the patentee discloses that the thickness of the coating layer can be regulated by the rate of relative movement. Although a seal may be provided in the region of the flared lip of the container, it is deemed to be nonessential, because the amount of powder which would otherwise be lost is considered to be negligible.

The Major et al specification describes a method and apparatus for applying a coating of powered silica to the inside surface of an incandescent lamp envelope; in some cases the particulate material can be charged electrically by blowing it through a zone of ionization. The apparatus comprises a long glass tube, at the bottom of which is a diffusing pad covered by a layer of glass balls and, in turn, a reservoir located directly beneath the vessel being coated; particles that are too large to be sustained by the upwardly moving gas stream will be returned to the reservoir, and the delivery tube may be moved vertically within the object during the coating operation.

Certain fluidized bed units described in the art employ vacuum systems for exhausting fumes and recovering undeposited powder. Exemplary disclosures are set forth in Facer et al U.S. Pat. No. 3,560,239, issued Feb. 2, 1971, Huteaux U.S. Pat. No. 3,799,112, issued Mar. 6, 1974, and Walling et al U.S. Pat. No. 4,073,265, issued Feb. 14, 1978. A powder handling system, adapted for use with fluidized bed coating equipment, is described in Carlson et al U.S. Pat. No. 4,123,175, issued Oct. 31, 1978.

Despite the activity in the art exemplified by the foregoing, a need exists for means by which surfaces of workpieces can be coated quickly and efficiently with a particulate material from an electrostatic fluidized bed, which affords means for replenishing, in a optimal manner, the supply of particulate material in the fluidization chamber. Accordingly, it is the broad object of the present invention to provide a novel apparatus and method having such features and advantages.

Another object of the invention is to provide such an apparatus and method which are especially adapted for use in coating workpieces with a particulate material having abrasive properties.

Other objects of the invention are to provide such an apparatus which is relatively economical to build, and convenient to use.

SUMMARY OF THE INVENTION

It has now been found that certain of the foregoing and related objects of the invention are attained by the provision of electrostatic fluidized bed coating apparatus that includes a housing having a generally planar, porous support member mounted therein to define a fluidization chamber thereabove, and an underlying plenum. Means is provided for electrostatically charging particulate material supplied to the upper surface of the support member, and for introducing air into the plenum for fluidization of particulate material disposed on the support member. A reservoir chamber is disposed below the plenum, and means is provided for delivering particulate material from the reservoir chamber to the fluidization chamber. Also included in the apparatus is delivery means, comprising means for lifting particulate material from the reservoir chamber and depositing it onto the porous support member within the housing. The lifting means includes structure defining a bore extending vertically between the fluidization chamber, such structure having upper and lower ends opening, respectively, over the support member and adjacent the bottom of the reservoir chamber; it will also usually include a rotatable screw extending through the bore, and drive means for effecting rotation of the screw so as to lift the particulate material. Means is provided for injecting air into the reservoir chamber in the vicinity of the lower end of the bore-defining structure, so as to effect agitation of particulate material thereat, which means comprises a second porous support member, at the bottom of the reservoir chamber, and structure defining a second plenum therebelow. Particulate material deposited upon the second support member may thus be fluidized by pressurized air introduced into the second plenum, so as to effect agitation thereof.

In preferred embodiments, the upper end of the bore-defining structure will delivery the particulate material to a central location on the upper surface of the first-mentioned support member, and the lower end thereof will be aligned over a portion of the "second" support member. The "second" plenum-defining structure will usually comprise a second housing disposed below the reservoir chamber, and the drive means will comprise a motor disposed below the second housing, in operative engagement with the lifting screw.

Additional objects are attained by the provision of an electrostatic method, utilizing an electrostatic fluidized bed coating apparatus constructed as described herein. The method includes the steps: supplying a quantity of particulate material, capable of acquiring an electrostatic charge, to an upper surface of the support member; positioning a workpiece proximate the fluidization chamber of the coating apparatus; operating the apparatus so as to produce from the particulate material, upon and over the support member, a fluidized bed and a cloud of electrostatically charged particles; maintaining the workpiece at an electrical potential that is effectively opposite to the potential of the electrostatically charged particles, thereby causing the particles to be attracted to, to deposit upon, and to adhere to the surfaces of the workpiece, to effect coating thereof; supplying a quantity of the particulate material to an upper surface of the second support member; injecting air under pressure into the second plenum, so as to produce a fluidized bed of particles on the second support member; and continuously delivering, during the charged cloud-producing step, particulate material from the fluidized bed in the reservoir chamber to the fluidization chamber.

Particular benefit is derived, from the practice of the instant invention, in those instances in which the particulate coating material employed is of an abrasive character.

BRIEF DESCRIPTION OF THE DRAWINGS

FIG. 3 is a fragmentary elevational view, in partial section, showing an improvement to the system of FIGS. 1 and 2 and constituting an embodiment of the present invention; and FIG. 4 is a fragmentary elevational view, in partial section, showing additional modifications that may be made to the systems of the foregoing Figures.

DETAILED DESCRIPTION OF THE ILLUSTRATED EMBODIMENTS

Figure 1:
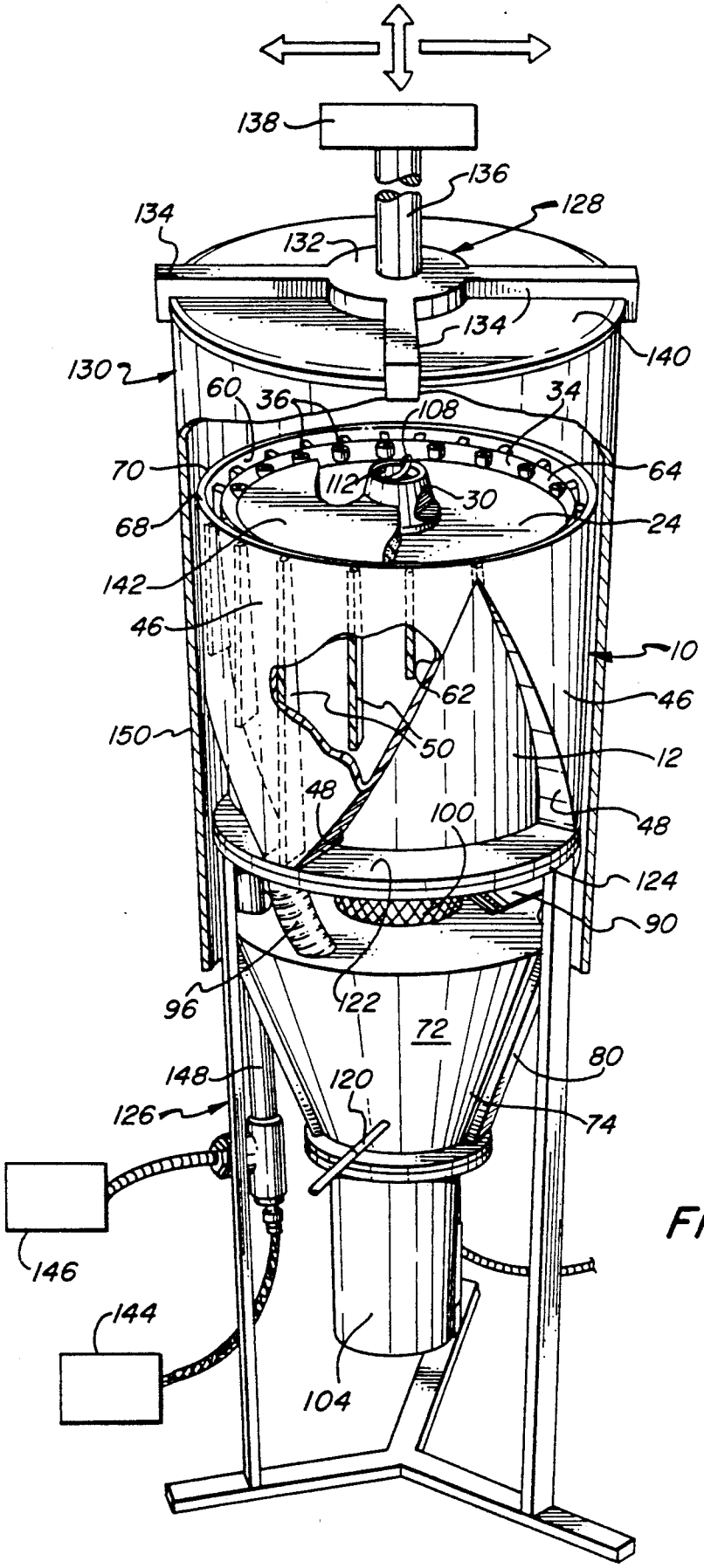
FIG. 1 is a fragmentary perspective view of a system of the kind that embodies the present invention, showing a cylindrical tank or vessel having one end closed and one end open, during the coating operation.
Figure 2:
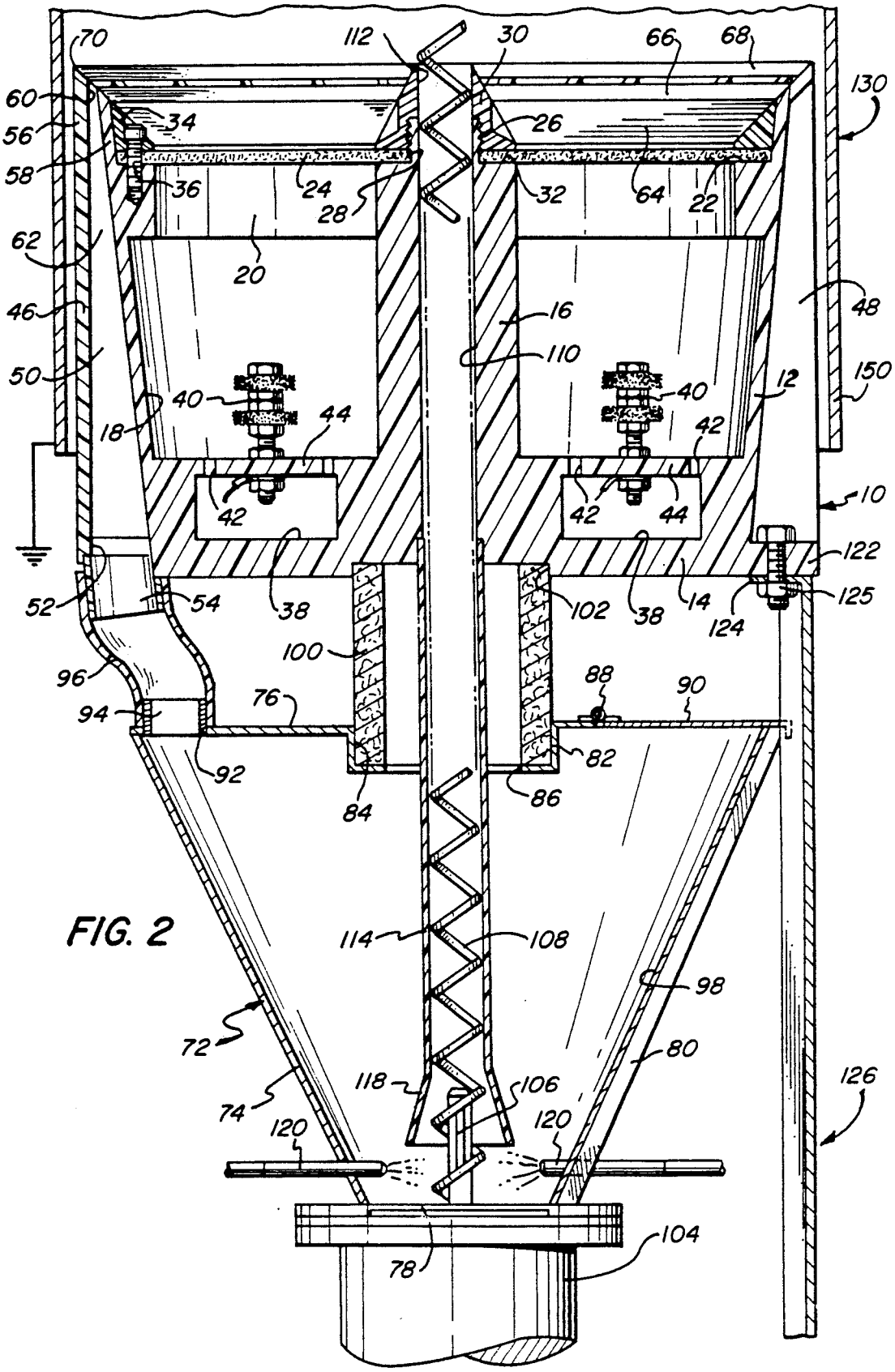
FIG. 2 is a fragmentary vertical sectional view thereof.

Turning now in detail to FIGS. 1 and 2 of the appended drawings, therein illustrated is an electrostatic coating system, into which may be incorporated the improvements embodying the present invention, which utilizes a fluidized bed unit comprised of a housing, generally designated by the numeral 10. The housing 10 consists of a frustoconical sidewall portion 12, a base portion 14, and a central core portion 16, cooperatively defining a relatively deep, generally annular plenum 18 therewithin. The sidewall portion 12 is formed with an enlarged, circumferential shoulder 20, which provides a surface 22 upon which the outer marginal portion of an annular porous plate 24 is supported. The core portion 16 has a threaded neck component 26 at its upper end, which extends through the central aperture 28 of the porous plate 24 and engages an internally threaded cap 30, of frustoconical configuration. As will be appreciated, the cap 30 is tightened upon the threaded neck component 26 to secure the inner marginal portion of the porous plate against the shoulder surface 32 formed on the core portion 16 at the base of the neck component 26; the outer marginal portion of the plate is held in place by the clamping piece 34, which is of triangular cross section and is secured by a number of bolts 36.

An annular chamber 38 is formed within the base portion 14 of the housing 10. Electrode means, comprising an array of wire brush-like members 40, are disposed upon the top wall component 44 of the base portion, the latter having small apertures 42 therethrough to provide air-flow communication with the chamber 38. Such an arrangement has been disclosed heretofore (see for example the above-identified Karr patent), and serves to generate ionized air in a highly efficient manner.

Three identical trough-like structures are provided about the housing 10, each defined by an exterior wall portion 46 and two downwardly converging lateral wall portions 48, in cooperation with the section of the sidewall portion 12 that is coextensive with the exterior wall portion 46. A set of five vertical ribs 50 are contained within each trough-like structure for reinforcing purposes, and it will be noted that the ribs aligned over the lateral wall portions 48 terminate short thereof. The lateral wall portions 48 lead to a port 52, from which extends a collar component 54.

The exterior wall portions 46 terminate in a continuous, beveled upper edge component 56, which is spaced slightly from the horizontally aligned component 58 of the sidewall 12, thereby defining a relatively narrow throat portion 60 leading into the spaces 62 within the trough-like structures surrounding the housing. It will be noted from FIG. 2 that the bevelled surfaces 51, 64, 66 and 68 on the internal ribs 50, the clamping ring 34, the edge component 58 of the sidewall 12, and the edge component 56 of the exterior wall portions 46, respectively, lie on a common, imaginary frustoconical surface, and thereby provide a substantially continuous inclined surface from adjacent the porous plate 24 to the outermost edge element 70 circumscribing the exterior wall portions 46.

A hopper, generally designated by the numeral 72, is disposed beneath the fluidized bed unit and comprises a frustoconical sidewall portion 74, a top wall portion 76, and a bottom wall portion 78, the sidewall portion 74 being reinforced by ribs 80. Ledge structure 82 defines a recess 84 in the top wall 76 of the hopper, and circumscribes a relatively large opening 86. A second opening 88, normally closed by a hinged door 90, and a relatively small port 92 circumscribed by a short collar 94, are also formed in the top wall portion 76. The collar 94 receives one end of a flexible conduit 96, which is engaged at its opposite end upon the collar component 54 that surrounds the port 52 from one of the trough spaces 62 of the coating unit housing; as will be appreciated, the other trough-like structures are connected to the hopper chamber 98 by similar means. The recess 84 in the top wall portion 76 seats one end of a cylindrical filter element 100, the opposite end of which is seated within a recess 102 that extends upwardly into the base portion 14 of the housing 10.

The bottom wall portion 78 of the hopper 72 supports a variable speed electric motor 104, which has an upstanding shaft 106 to which is attached a screw 108. The screw 108 extends upwardly through the bore 110 within the core portion 16 of the housing, and through the bore 112 of the cap 32 engaged thereupon, protruding a short distance outwardly therebeyond. The lower portion of the screw 108 is received within a rigid cylindrical guide pipe 114, the upper end of which is engaged within a secondary recess 166 formed into the base portion 14; the lower end portion 118 of the pipe 114 is of frustoconical configuration. Three nozzles 120 (only two of which are visible in FIG. 2) extend radially through the bottom of the hopper sidewall 74, to points adjacent the end portion 118 of the guide pipe 114.

Support for the coating apparatus is provided by a stand, generally designated by the numeral 126. The housing of the fluidized bed unit 10 has laterally extending circumferential flange components 122 on its base portion 14, which rests upon the upper ring 124 of the stand 126 and are secured thereto by a nut and bolt fastener 125; the hopper 72 is suspended from the ring 124, by means which is not shown.

As indicated in FIG. 1, the conveyor of the system includes a multiplicity of attaching fixtures, generally designated by the numeral 128, each of which is capable of supporting an open-ended tank, generally designated by the numeral 130, with its open end downwardly disposed. The fixture 128 consists of a hub 132, from which extends four radial gripping arms 134. The post 136 on the hub may be considered to be the axially movable shaft of a diagrammatically illustrated elevating mechanism 138. As noted by the arrows, the conveyor is adapted to move the supported object to and from the location of the coating unit, as well as vertically with respect thereto. The system will also include a high voltage source 144 and an air source 146, the electrical power and air supply being introduced through the common pipe 148 and being attached, respectively and by means not shown, to the electrode members 40 and the compartment 38 within the base portion 14. The air supply 146 will in addition be connected to the nozzles 120, and suitable valves and other control devices will of course be operatively interposed, as appropriate.

In operation of the system, the tank 130 will initially be carried to a position of axial alignment over the coating apparatus, as may be achieved automatically, and the elevating mechanism 138 associated with the conveyor will then be activated to cause the tank to descend over the fluidized bed unit. When the bottom wall 140 has been brought to a position proximate the fluidization chamber, the coating unit will be fully activated, with air flowing through the chamber 38 and power supplied to the electrode members 40, causing the particulate coating material 142 supplied to the upper surface of the porous plate 24 to be fluidized and electrostatically charged by the ionized air generated within the plenum 18, which flows through the plate 24 into the bed thereof.

The charged particles will of course be attracted to the adjacent surfaces of the grounded tank 130, to deposit initially upon the surface of the end wall 140. Upward withdrawal of the tank will cause the powder to deposit progressively upon the surface of the sidewall 150, as fresh portions become exposed behind the rim 70 of the fluidized bed, thereby gradually developing a deposit over the entire sidewall surface. When the coating operating has been completed, the conveyor will of course carry the tank 130 from the vicinity of the coating apparatus to successive stations of the system, at which the deposited material is fused and hardened by means well-known to those skilled in the art, so as to produce the desired, integrated coating.

It will be appreciated that during operation of the coating unit the fluidized particulate material will flow over the surfaces 64, 66, 68, due to the influence of both the fluidizing air and also the electrostatic attraction induced by the grounded tank 130. Of course, not all of the powder leaving the fluidization chamber will adhere to the tank surface, which is at least in part a consequence of the desirable self-limiting build effect that is characteristic of electrostatic powder coating. A very high proportion of the undeposited or nonadhering powder will enter the throat portion 60 of the trough-like structures on the exterior of the coating unit, and will descend through the interior spaces 62 to ultimately collect in the reservoir chamber 98 of the hopper 72. The screw 108, rotated by the motor 104 (at a speed appropriate to replenish the powder used to coat the workpiece, and to maintain a desirable depth thereof on the plate 24), will carry the powder from the hopper upwardly through the pipe 114 and the bores 110, 112, ultimately delivering it to the middle of the porous plate 24; normally, the recirculation system will be operated only during the coating phase. Air injected through the nozzles 120 will serve to agitate the powder in the lower end of the hopper, keeping it from packing and thereby assisting entry into the mouth of the funnel section 118. Pressure buildup within the hopper is avoided by permitting air to escape through the filtered opening 86, and fresh powder is added, as necessary, through the opening 88.

It will be noted that the collection of undeposited particulate material is effected through simple gravitational flow, and without the imposition of any vacuum effect. Not only does the absence of any evacuation system simplify the design of the coating unit and afford economic benefits, but it is also believed to maximize powder deposition and retention on the surfaces being coated, by avoiding air-flow currents that would otherwise be induced.

It is also to be noted that in the normal mode of operation coating is effected only during the withdrawal phase; i.e., during separation of the workpiece and the bed. Consequently, any tendency that exists for powder to escape through the gap between the surfaces of the object and the coating unit walls is largely counteracted by the upward movement of the object, relative to the unit, which promotes an upward flow of the particles. While this minimized the amount of coating material lost from the system, it will usually be desirable, nevertheless, to position a vacuum unit near the open end of the object being coated; such a unit will serve to recover the small amount of material that does escape, or that is dislodged from the coating surface, so as to maintain cleanliness in the work area.

Although, in the illustrated embodiment of the system, a mechanism associated with the conveyor is employed to vary the elevation of the object during coating, it will be appreciated that the means for achieving the necessary relative movement could be incorporated into the coating apparatus instead. Thus, rather than utilizing a stand of fixed configuration, a structure having extensible legs could be provided, with means for extending and retracting the components thereof to raise and lower the coating unit, if so desired.

The shallowness of the fluidization chamber of the coating unit minimizes the distances through which the charged particles must move to deposit upon the workpiece surface, and thereby maximizes the effect of the electrostatic attracting forces. This, coupled with the high density electrostatic field that is created because of the large mass of the grounded object, permits the particulate material to deposit as a heavy, uniform build, even in corners of the object being coated (for example, at the junction of the bottom and sidewall portions 140, 150 of the tank 130). A Faraday's cage effect would normally inhibit such a coating application, and attempts to counteract that effect, such as by blowing powder at high velocity into the corners, have been most unsuccessful. It is also important to note that the configuration of the closed-loop collection and delivery arrangement incorporated into the apparatus not only affords efficiency and convenience of powder handling, but it enhances the effectiveness of coating as well; electrostatic charge transfer is achieved very efficiently as the particulate material migrates uniformly and at an even rate from the point of entry at the center of the bed, and across the porous plate. As can be seen, the plenum of the coating unit is made relatively deep, so as to space the charging electrodes an optimal distance below the porous plate and thereby ensure that no arcing to the workpiece will occur at operating voltages (typically 50 to 60 KV).

Although the apparatus illustrated in FIGS. 1 and 2 and hereinabove described is highly effective for its intended purposes, in those instances in which the coating material employed is of an abrasive nature (e.g., a vitreous frit), that apparatus suffers from a substantial drawback. Air injected through the nozzles 120 produces a sand-blast effect with the abrasive particles, tending to destroy components at the bottom of the hopper 72 and, in fact, quickly wearing holes in the sidewall 74 at the points of impact. The modification to which the present invention is directed, illustrated in FIG. 3 of the drawings, virtually eliminates problems associated with the use of abrasive particulate materials, with no sacrifice in the effectiveness of the delivery system for returning the coating material to the electrostatic fluidized bed section of the apparatus. Indeed, the modified system offers advantages which render its use highly desirable irrespective of the abrasiveness of the particulate coating material.

It should be understood that the features and components of which the embodiments of FIGS. 3 and 4 are comprised are the same as or similar to those of FIGS. 1 and 2, except insofar as express description hereinbelow, or the context, might indicate otherwise. Where parts are similar to those previously referred to, but of altered form or construction, the same numbers are employed, but differentiated by priming them.

Turning now more specifically to FIG. 3, it can be seen that the hopper 74' has a flange portion 172, which rests upon the upper surface 174 of a lower plenum body, the body being generally designated by the numeral 150, and being comprised of a generally annular sidewall 151 and a top wall 152 spanning the upper end thereof. An annular porous plate 154 is seated upon the upper surface of the top wall 152, the openings 156 and 158 thereof being coaxially aligned to receive therethrough the screw or auger 108' of the powder delivery system; a sealing ring 160, seated within the opening 158 and beneath the overhang of the plate 154, bears upon the shank portion 180 of the auger 108'.

The sidewall 151 defines a plenum 162 in cooperation with the top wall 152, the porous plate 154, and the housing of the motor 104'. A port 164 is formed through the sidewall 151, enabling a supply of air under pressure to be provided to the plenum 162 through the hose 166, which is attached to the port 164 by the coupling components 168.

As will be appreciated, air flowing through the port 164 passes upwardly from the plenum 162 through the openings 170 in the top wall 152, diffusing through the porous plate 154 and exiting into the hopper 72'. Particulate matter supported upon the plate 154, within the reservoir chamber 98', will thereby be fluidized, thus facilitating its transport across the plate 154 and into the vicinity of the auger 108'. During rotation by the motor 104', the screw portion 183 of the auger 108' will carry the particulate matter upwardly through the bore of the guide pipe 114', the lower end of which is flared to facilitate entry and collection.

The shank portion 180 of the auger 108' is splined to engage the elements 182, which are in turn attached (by means not shown) to the drive shaft of the motor 104'. The motor housing is provided with outwardly projecting ear portions 176 which, like the flange 172 of the hopper 72' and the sidewall 153 of the housing 150, have appropriate apertures or passages for the receipt of nut and bolt fasteners 178, a plurality of which serve to secure the hopper 72', the housing 150 and the motor 104' in vertical assembly with one another.

FIG. 4 shows additional modifications that may be made to the apparatus of FIGS. 1–3. One change involves the elongation of the stem 39 of the brush electrodes 40' (only one electrode being shown), so as to elevate the charging heads 41 thereof. This enhances electrostatic efficiency by reducing the distance over which air that is ionized thereby must flow before contacting the particulate material.

The apparatus is also modified so as to enable vibration of the electrostatic fluidized bed housing 10', to thereby further improve coating efficiency. This entails thickening of one section 184 of the base portion 14', to better accommodate the weight of an electrically operated vibrator 186, and providing a stand 126' constructed to accommodate three rubber mounts, generally designated by the numeral 188 (only one of which is shown). The legs 190 of the stand 126' are joined at their upper ends to a top plate 191, whereat structure is provided to define U-shaped recesses 192 for seating the mounts 188.

Each mount consists of a cylindrical part 194, made of a tough, resilient, rubbery material, within which is embedded a lug. The lug has a threaded end portion 196 extending downwardly into the threaded engagement with the transverse web element 198, by which the bottom of the recess 192 is defined. An internally threaded bushing (not visible) is affixed within the piece 194 in axial alignment with the threaded portion 196 and in such position as to receive and engage the bolt 200, which extends through the flange component 122. Thus, the mounts 188 serve to securely but resiliently support the housing 10' for vibration upon the stand 126'.

The composition of the particulate material employed in the practice of the invention may vary widely, and may include thermoplastic or thermosetting natural and synthetic resinous materials, in addition to inorganic oxide powders and the like. As a specific example, the tank shown in the drawings may be intended for use as a hot water vessel, in which case the particulate material may be a vitreous frit; i.e., an abrasive material of the kind for the handling of which the apparatus and method of the invention are especially suited.

It will be apparent that the overall configuration of the bed and the coating unit itself will depend upon the character of the workpiece. In those instances in which the workpiece has recessed surfaces that are to be coated, the bed will be configured so as to best conform to the shape thereof. As an alternative of the illustrated hot-water tank, for example, the apparatus may be adapted for the coating of liners for domestic ovens, in which case the bed would have a square configuration. The important consideration, in such instances, is of course to provide a bed in which the marginal structure at the perimeter of the fluidization chamber will lie in close proximity of the object surface, while providing clearance that is just sufficient to permit ready insertion of the coating unit thereinto. It goes without saying that the instant apparatus and method are applicable for coating workpieces of virtually any configuration, be they individual objects or of continuous length (e.g., webs, wires, strands, etc.), and that it will be configured so as to most effectively perform its intended functions.

Details of construction of the apparatus, and the nature of the materials suitable for use therein, are now well known in the art and need therefore not be specifically discussed. It might be mentioned however that dielectric plastics will desirably be employed for many components, such as the auger 108', for maximum efficiency and safety. It will also be appreciated by those skilled in the art that many variations may be made in components of the apparatus without departure from the concepts of the invention. For example, although the illustrated rotatable screw or auger, with its associated drive means, comprises a highly effective lifting system, it is possible that other mechanical means, and indeed pneumatic effects alone, may be substituted. Also, the apparatus may include a wide variety of powder recovery and collection means, the particular design of which will often depend primarily upon the nature of the workpiece involved.

Thus, it can be seen that the present invention provides a novel apparatus and method by which surfaces of workpieces can be coated quickly and efficiently with a particulate material from an electrostatic fluidized bed, which affords means for replenishing, in an optimal manner, the supply of particulate material in the fluidization chamber. The apparatus and method of the invention are especially adapted for use in coating workpieces with a particulate material having abrasive properties, and the apparatus is relatively economical to build and is convenient to employ.

Having thus described the invention, what is claimed is:

1. Electrostatic fluidized bed coating apparatus adapted for coating surfaces of workpieces, comprising in combination: a housing having a generally planar porous support member mounted therein to define within said housing a fluidization chamber thereabove and a plenum therebelow; charging means for electrostatically charging particulate material supplied to an upper surface of said support member; means for introducing air into said plenum for fluidization of particulate material disposed on said upper surface; a covered reservoir chamber disposed below said plenum; and delivery means for delivering particulate material from said reservoir chamber to said fluidization chamber; said delivery means comprising means for lifting particulate material from said reservoir chamber and depositing it onto said porous support member within said housing, said means for lifting including structure defining a bore extending vertically between said reservoir chamber and said fluidization chamber and having upper and lower ends opening over said support member and adjacent the bottom of said reservoir chamber, respectively; said apparatus additionally including means for injecting air under pressure into said reservoir chamber, in the vicinity of said lower end of said bore-defining structure, to effect agitation of particulate material thereat, said means for injecting air comprising a second porous support member at the bottom of said reservoir chamber, and structure defining therebelow a second plenum having an air introduction port, so that particulate material deposited upon said second support member may be fluidized by air under pressure introduced through said port into said second plenum, so as to effect agitation thereof.

2. The apparatus of claim 1 wherein said means for lifting additionally includes a rotatable screw extending through said bore, and drive means for effecting rotation of said screw so as to lift the particulate material.

3. The apparatus of claim 2 wherein said second plenum-defining structure comprises a second housing disposed below said reservoir chamber, and wherein said drive means comprises a motor disposed below said second housing, said screw passing through said second housing into operative engagement with said motor.

4. The apparatus of claim 1 wherein said upper end of said bore-defining structure delivers the particulate material to a central location on said upper surface of said first-mentioned support member, and wherein said lower end of said bore-defining structure is aligned over a portion of said second support member.

5. The apparatus of claim 1 wherein said reservoir chamber is provided by a hopper member that is separate from, and disposed below, said first-mentioned housing.

6. An electrostatic method for coating surfaces of a workpiece with a particulate material, including the steps:

(a) providing an electrostatic fluidized bed coating apparatus, comprising in combination: a housing having a generally planar porous support member mounted therein to define within said housing a fluidization chamber thereabove and a plenum therebelow; charging means for electrostatically charging particulate material supplied to an upper surface of said support member; means for introducing air into said plenum for fluidization of particulate material disposed on said upper surface; a covered reservoir chamber disposed below said plenum; and delivery means for delivering particulate material from said reservoir chamber to said fluidization chamber; said delivery means comprising means for lifting particulate material from said reservoir chamber and depositing it onto said porous support member within said housing, said means for lifting including structure defining a bore extending between said reservoir chamber and said fluidization chamber and having upper and lower ends opening over said support member and adjacent the bottom of said reservoir chamber, respectively; said apparatus additionally including means for injecting air under pressure into said reservoir chamber, in the vicinity of said lower end of said bore-defining structure, to effect agitation of particulate material thereat, said means for injecting air comprising a second porous support member at the bottom of said reservoir chamber, and structure defining therebelow a second plenum having an air introduction port, so that particulate material deposited upon said second support member may be fluidized by air under pressure introduced through said port into said second plenum, so as to effect agitation thereof;

(b) supplying a quantity of particulate material, capable of acquiring an electrostatic charge, to said upper surface of said first-mentioned support member;

(c) positioning a workpiece proximate said fluidization chamber of said coating apparatus;

(d) operating said apparatus so as to produce from said particulate material, upon and over said first support member, a fluidized bed and a cloud of electrostatically charged particles;

(e) maintaining said workpiece at an electrical potential that is effectively opposite to the potential of said electrostatically charged particles, so as to cause said particles to be attracted to, to deposit upon, and to adhere to the surface of said workpiece, to effect coating thereof;

(f) supplying a quantity of said particulate material to an upper surface of said second support member;

(g) injecting air under pressure into said second plenum so as to produce a fluidized bed of said particles on said second support member, in said reservoir chamber; and (h) continuously delivering, during said step (d), particulate material from said fluidized bed in said reservoir chamber to said fluidization chamber.

* * * * *